US005134683A

United States Patent [19]

Powell

[11] Patent Number: 5,134,683

[45] Date of Patent: Jul. 28, 1992

[54] WATER HEATER WITH INTEGRAL DRAINAGE CATCH PAN STRUCTURE

[75] Inventor: Timothy E. Powell, Tallassee, Ala.

[73] Assignee: Rheem Manufacturing Company, New York, N.Y.

[21] Appl. No.: 714,194

[22] Filed: Jun. 12, 1991

[51] Int. Cl.[5] ..... F24H 1/18

[52] U.S. Cl. ..... 392/449; 126/361; 126/344; 137/312; 122/504

[58] Field of Search ..... 392/449, 451, 454; 122/504, 494; 137/312, 314; 126/361, 344, 383, 385, 363, 51, 373; 220/469, 627

[56] References Cited

U.S. PATENT DOCUMENTS

| | | | |
|---|---|---|---|
| 1,802,085 | 4/1931 | Lonergan | 220/469 |
| 2,328,245 | 8/1943 | Yavitch | 126/363 |
| 2,460,054 | 1/1949 | Wiggins | 220/627 |
| 2,531,159 | 11/1950 | Rowell | 137/312 |
| 2,724,401 | 11/1955 | Page | 137/403 |
| 2,944,563 | 7/1960 | De Blasio | 137/312 |
| 3,069,671 | 12/1962 | Taylor | 340/244 |
| 3,473,553 | 10/1969 | Collins | 137/312 |
| 4,413,592 | 11/1983 | Jones | 122/510 |
| 4,739,895 | 4/1988 | Bachmann | 220/627 |
| 4,765,360 | 8/1988 | Baird | 137/312 |
| 4,860,728 | 8/1989 | Nelsen | 122/494 |
| 4,862,909 | 9/1989 | Kim | 137/150 |
| 4,939,833 | 7/1990 | Thomas | 137/312 |
| 4,944,253 | 7/1990 | Bellofatto | 122/504 |
| 5,085,205 | 2/1992 | Hall et al. | 126/363 |

FOREIGN PATENT DOCUMENTS

| | | | |
|---|---|---|---|
| 7510537 | 9/1975 | Netherlands | 126/363 |

*Primary Examiner*—Bruce A. Reynolds
*Assistant Examiner*—John A. Jeffery
*Attorney, Agent, or Firm*—Konneker & Bush

[57] ABSTRACT

An electric water heater is provided with a vertically enlarged, sealed bottom end cap which functions as an integral drainage catch basin to receive water leaking from the water heater's internal hot water storage tank into the annular space between the storage tank and the outer jacket of the water heater. A drain pipe extends through a sealed opening in the end cap and is used to drain away water entering the cap, thus eliminating the previous necessity of providing the water heater with a separate drainage catch pan structure. The storage tank is electrically grounded to the outer water heater jacket at a point above the bottom end cap, thus eliminating the necessity of forming this grounding interconnection with a grounding screw extending upwardly through the bottom end cap and forming a water leak path through the bottom of the end cap.

12 Claims, 2 Drawing Sheets

WATER HEATER WITH INTEGRAL DRAINAGE CATCH PAN STRUCTURE

BACKGROUND OF THE INVENTION

The present invention relates generally to water heaters, and more particularly relates to apparatus and methods for receiving and draining away water leaking from the internal storage tank portion of a water heater.

Electric water heaters used to supply hot water to a variety of plumbing fixtures, such as sinks, tubs, showers and dishwashers, typically include a vertically oriented cylindrical metal water heating and storage tank coaxially disposed within an outer cylindrical metal jacket having an open lower end, and a diameter somewhat larger than that of the storage tank. A suitably insulation material is positioned within the annulus between the jacket and the storage tank and circumscribes the tank.

To hold the insulation within the jacket annulus, a short metal end cap is telescoped over the open lower end of the jacket and secured thereto with several screws extended inwardly through the end cap sidewall and into a lower end portion of the jacket side wall. To form a necessary grounding interconnection between the metal jacket and the metal storage tank, a metal grounding screw is customarily threaded upwardly through a central opening in the bottom wall of the end cap and into a lower end portion of the storage tank.

An electric resistance heating element extended into the storage tank is operated, under the control of a thermostat, to heat water stored in the tank to a predetermined temperature for supply to the plumbing fixture(s) to which the water heater is connected. Water supplied under pressure from the storage tank is automatically replenished through a cold water fill line operatively connected to the tank.

Because the water heater is typically hidden from view in a storage closet or the like, a leak in the storage tank portion of the water heater usually goes undetected. Water leaking from the tank enters the interior jacket annulus and quickly leaks out of the bottom of the water heater through the unsealed interface between the bottom end of the jacket and the bottom end cap and/or through holes in the bottom wall of the end cap (such as the hole for the grounding screw). If appropriate preventive measures are not taken, this undetected storage tank leakage can extensively flood and damage the heater storage floor (and surrounding floor areas) before the leakage is discovered.

The longstanding conventional solution to this tank leakage problem has been to provide a separate cylindrical catch pan which is coaxially positioned against the bottom end cap of the water heater. For example, the catch pan is placed on the floor (or a support shelf, as the case may be), and the bottom end of the water heater is supported on the bottom wall of the catch pan. The diameter of the catch pan is somewhat larger than the diameter of the bottom jacket end cap. Accordingly, there is defined within the pan an annular water receiving volume which outwardly circumscribes a lower end portion of the water heater.

In the event of a storage tank leak, water leaking from the internal storage tank and flowing outwardly through the bottom end of the water heater does not come in contact with the storage room floor. Instead, it flows into the annular receiving volume of the pan and is drained therefrom, via a suitable drain line connected to the pan, to a nearby floor drain or other drainage plumbing. Accordingly, the tank leak may continue, until detected and fixed, without flooding the storage area floor and surrounding floor areas.

Despite the widespread acceptance of separate catch pan structures, they are subject to a variety of well known problems, limitations and disadvantages. For example, the use of an auxiliary catch pan positioned beneath the overall water heater structure requires that an additional water heater component be fabricated, and then later installed at the job site, thereby increasing both the total manufacturing and installation costs associated with the overall water heating system.

Additionally, the heretofore required use of the separate catch pan increases the horizontal "footprint" of the overall water heater assembly. This undesirably increases the total water heater storage space requirements and (when the separate catch pan is shipped with its associated water heater) the overall shipping volume associated with the water heater.

It can be readily seen from the foregoing that it would be desirable to provide improved apparatus and methods for receiving and draining away water leaking from the internal storage tank portion of a water heater. It is accordingly an object of the present invention to provide such improved apparatus and methods.

SUMMARY OF THE INVENTION

In carrying out principles of the present invention, in accordance with a preferred embodiment thereof, an improved water heater is provided with an integral drainage catch pan structure which permits water leaking from the storage tank portion of the heater to be drained away, to a floor drain or other drainage plumbing, without the previous necessity of positioning a separate drainage catch pan beneath the water heater.

The improved water heater includes an outer jacket having an open lower end portion, and a hot water storage tank coaxially disposed within the jacket and adapted to hold a quantity of heated water for supply to a hot water-using device, the outer jacket and the storage tank forming therebetween and being generally coaxial with an interior space disposed within the water heater and horizontally circumscribing the storage tank.

A circular bottom end cap is telescoped upwardly over the open lower end portion of the outer jacket and is suitably secured thereto. The bottom end cap is converted to the aforementioned integral drainage catch pan structure by the provision of sealing means for forming a water tight seal between the bottom end cap and the open lower jacket end portion received therein to thereby prevent water leaking from the storage tank into the bottom end cap from flowing upwardly out of the end cap. Outlet means are extended into the interior of the bottom end cap and are connectable to an external drain pipe to drain away storage tank leakage water received within the bottom end cap.

In this manner, storage tank leakage water may be captured and drained away directly from within the interior of the water heater to a plumbing drainage structure, such as a floor drain, thereby eliminating the necessity of placing a separate drainage catch pan structure beneath the water heater.

The outlet means may be communicated with the interior of the bottom end cap through either a side wall or a lower end wall portion thereof, and the requisite electrical grounding interconnection between the storage tank and the outer jacket is preferably made at a location above the bottom end cap to eliminate the end cap grounding screw conventionally used to form this grounding connection.

DETAILED DESCRIPTION

Figure 1:
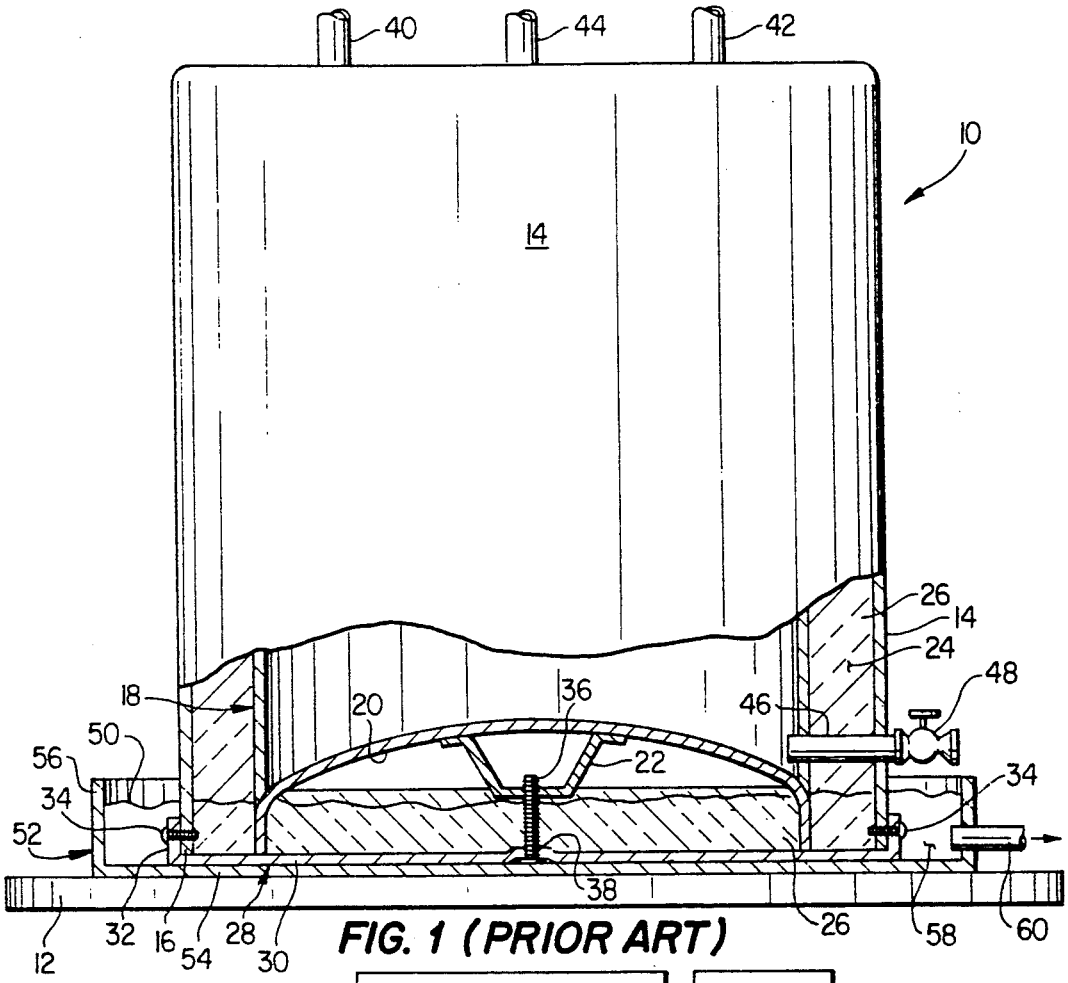
FIG. 1 (PRIOR ART)
FIG. 1 (Prior Art) is a simplified, partially sectioned side elevational view of a representative conventional electric water heater operatively associated with the usual separate drainage catch pan positioned beneath its bottom end to receive and drain away water leaking from the water heater's interior storage tank, the wall thicknesses of the water heater being shown at an enlarged scale for purposes of illustrative clarity.

Illustrated in FIG. 1 (Prior Art) is a conventional electric water heater 10 which is representatively of the small gallonage "point of use" type typically utilized to supply hot water to one or a limited number of plumbing fixtures such as sinks, bathtubs, showers and the like. Small electric water heaters of this type typically have a hot water storage capacity of from about two gallons to about twenty gallons, and are customarily positioned as close as possible to the plumbing fixture(s) which they serve —usually being concealed within a storage area such as a storage closet or in cabinet areas or the like. The water heater 10 is representatively shown supported on an elevated shelf 12 in one of these storage areas, but could also be placed on the floor thereof if desired.

The water heater 10 has a cylindrical outer metal jacket 14 with an open lower end 16, and a cylindrical metal hot water storage tank 8 coaxially disposed within jacket 14 and having a concave lower end 20 from which a central metal transition bracket structure 22 depends. The diameter of tank 18 is somewhat smaller than that of the outer jacket 14. Accordingly, a vertically extending annular space 24 is formed between the jacket 14 and the tank 18. As illustrated, this annular space, and a bottom portion of the recessed lower tank end, is filled with a suitable insulation material 26.

To assist in retaining this insulation within the jacket, and to cover the open lower end of the jacket, a metal bottom end cap 28 is provided, the end cap having a circular bottom wall 30 with a relatively narrow circular side wall 32 extending upwardly from its periphery. As illustrated, the end cap 28 is outwardly telescoped over the open lower end of the jacket 14 and is removably secured thereto by means of a circumferentially spaced series of metal screws 34 extended inwardly through the end cap side wall 32 into an underlying lower end portion of the vertical jacket side wall. In order to make the necessary grounding interconnection between the jacket 14 and the storage tank 18, a metal grounding screw 36 is threaded upwardly through a circular opening 38 in the bottom end cap wall 30 and into the lower end of the transition bracket structure 22.

Extending downwardly into the storage tank 18 through the top end of the outer jacket 14 are the usual three pipes—a hot water supply pipe 40 for flowing pressurized heated water from tank 18 to the fixture(s) served by the water heater; a cold water inlet pipe 42 for replenishing water discharged from the tank to the fixture(s); and a relief pipe 44 connected to a temperature and pressure relief valve (not shown). Drainage of the storage tank 18 is provided for by means of a drain pipe 46 which is extended inwardly through jacket 14, and into a lower end of the tank 18, and has installed thereon a suitable manually operable drain valve 48.

In a wholly conventional manner, the pressurized water within the storage tank 18 is maintained at a predetermined heated supply temperature by an electric resistance heating element under the control of a thermostat (neither of which is shown in FIG. 1).

Leakage of the storage tank 18 causes tank water 50 to flow into the bottom of the jacket interior and then outwardly through the bottom of the jacket 14 between the overlapped areas of the bottom jacket end and the bottom end cap wall 32, and through the grounding screw hole 38 or through other openings. Because the water heater 10 is installed in an out-of-sight storage location, the leaking tank water 50 very often goes undetected until it floods the storage area floor, and surrounding floor areas, and creates resulting water damage in these areas.

The longstanding conventional solution to this hidden water leakage is to provide an auxiliary catch pan 52 which is placed beneath the water heater 10. As illustrated, the catch pan 52 has a circular bottom wall 54, upon which the bottom end of the water heater rests, which has a diameter larger than that of the water heater jacket 14. A circular side wall 56 extends upwardly from the periphery of the bottom wall 54 to a level higher than the upper edge of the end cap side wall 32.

The catch pan side wall 56 defines with a lower end portion of the water heater an annular receiving area 58 which captures water 50 leaking from the storage tank 18 and flowing outwardly through the bottom end of the water heater 10. Water 50 entering the annular receiving area 58 is drained away therefrom, to an adjacent floor drain, by a catch pan drain pipe 60. In this manner, the tank leak may continue for a considerable period of time, until detected and fixed, without flooding the storage area floor and surrounding floor areas.

Despite the widespread acceptance and use of separate water leakage receptacles, such as the illustrated auxiliary catch pan 52, they are subject to a variety of well known problems, limitations and disadvantages. For example, the use of an auxiliary catch pan positioned beneath the overall electric water heater structure requires that an additional water heater component be fabricated, and then later installed at the job site, thereby increasing both the total manufacturing and installation costs associated with the overall water heating system.

Additionally, the heretofore required use of the separate catch pan structure increases the horizontal "footprint" of the overall water heater assembly. This undesirably increases the total water heater storage space requirements and (when the separate catch pan is shipped with its associated water heater) the overall shipping volume associated with the water heater.

The present invention uniquely provides an improved electric water heater $10_a$ (FIG. 2) which avoids the necessity of utilizing an auxiliary catch pan structure to protect the floor of the water heater storage area from flooding in the event that the water heater storage tank begins to leak. For ease in comparison to the conventional water heater 10 (FIG. 1) just described, the improved water heater $10_a$ has been shown as having the same size and water storage capacity, with parts in water heater $10_a$ similar to those in water heater 10 being given the same reference numerals, but with the subscripts "a".

While the improved water heater $10_a$ has been illustrated as being an electric water heater having a relatively small "point of use" size and capacity, it will be readily appreciated that it could just as easily be water heater of a considerably larger size and water storage capacity if desired and/or could in some cases be a fuel-fired type of water heater.

To advantageously eliminate the necessity of utilizing the separate catch pan 52 (FIG. 1), the improved electric water heater $10_a$ is uniquely provided with an integral catch pan structure in the form of a vertically enlarged bottom metal end cap 70. End cap 70 (FIGS. 2 and 3) has a circular bottom wall 72, and a circular upstanding peripheral side wall 74 having a vertical height considerably greater than that of end cap side wall 56 (FIG. Specifically, as may be seen by comparing FIGS. 1 and 2, the end cap side wall 74 is vertically enlarged to a degree such that it extends upwardly to just beneath the drain valve $48_a$.

The vertically enlarged end cap 70 is installed on the water heater $10_a$ by telescoping it upwardly over a lower end portion of the jacket $14_a$, until the lower end $16_a$ of the jacket $14_a$ bottoms out within the cap 70. The installed end cap 70 is then held in place using the illustrated screws $34_a$ positioned adjacent the upper edge of the cap side wall 74.

Figure 3:
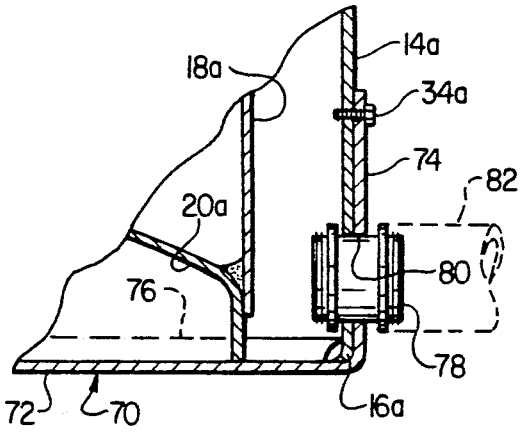
FIG. 3 is an enlargement of the dashed area "3" in FIG. 2, with the interior water heater jacket insulation removed for purposes of illustrative clarity.

The interface between the end cap 70 and a lower end portion of the jacket $14_a$ is sealed against water flow outwardly therethrough, preferably by utilizing an annular bead 76 of a suitable sealant compound extending inwardly around the open lower end $16_a$ of the jacket $14_a$ (see FIG. 3). Additionally, a drain nipple 78 is suitably sealed within an opening 80 formed through the jacket end $16_a$ and the end cap side wall 74. Via the nipple 78, and a suitable drain pipe 82 connected thereto, a lower end portion of the annular space $24_a$ within the water heater $10_a$ may be communicated with a floor drain or other plumbing drainage structure.

Figure 2:
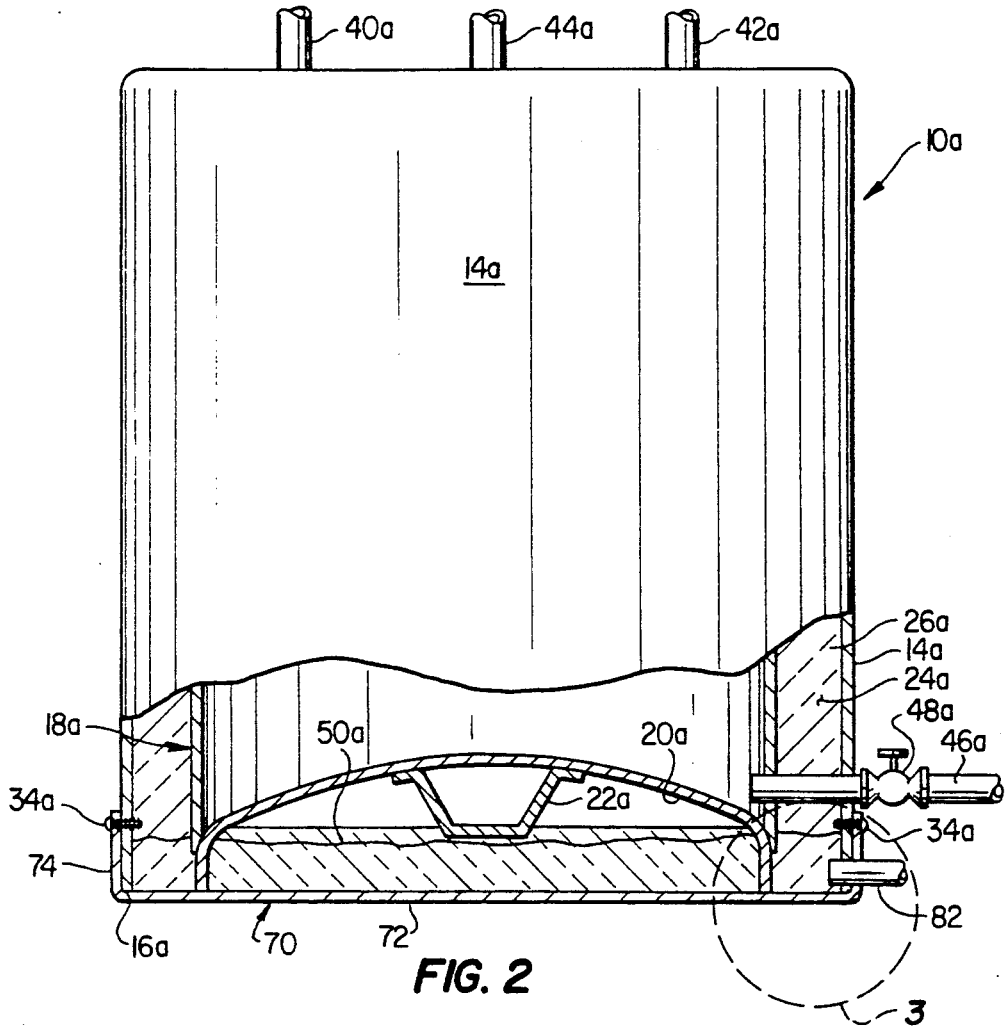
FIG. 2 is a simplified, partially sectioned side elevational view of an improved electric water heater which embodies principles of the present invention and incorporates therein an integral drainage catch basin structure which uniquely eliminates the necessity of utilizing the separate drainage catch pan shown in FIG. 1.

In addition to these modifications incorporated in the improved water heater $10_a$, it should be noted that the bottom grounding screw 36, and its associated end cap opening 38 (FIG. 1) are eliminated, thereby permitting the bottom end cap wall 72 to be of the illustrated imperforate construction shown in FIGS. 2 and 3.

Figure 4:
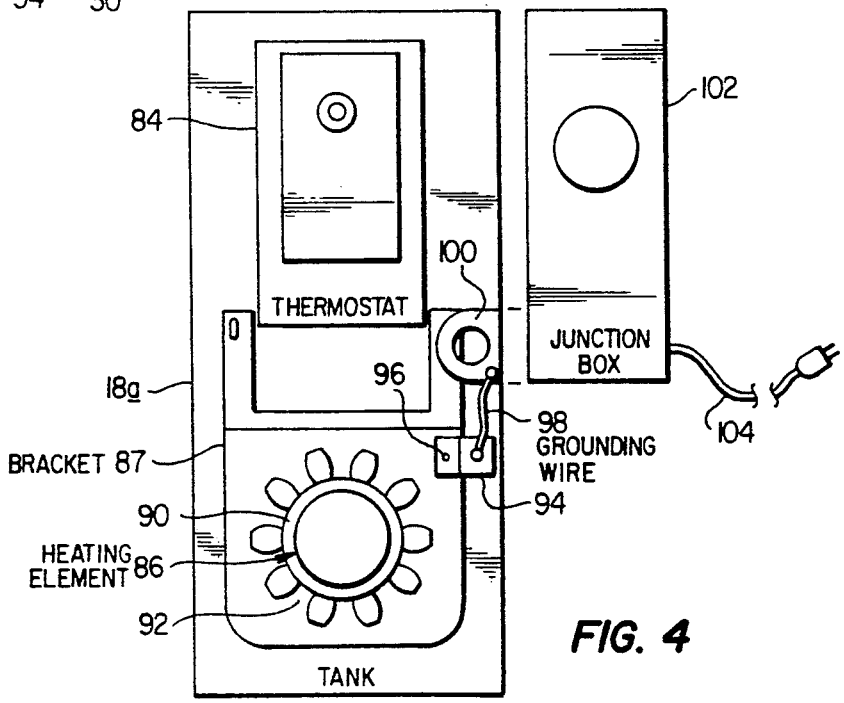
FIG. 4 is a schematic side elevational view of the interior storage tank portion of the FIG. 2 water heater illustrating the method used in the present invention to form a grounding interconnection between the storage tank and outer metal jacket portions of the water heater.

To compensate for the elimination of the bottom end grounding screw 36, the requisite grounding interconnection between the tank $18_a$ and the jacket $14_a$ is made in an alternate manner. Specifically, with reference now to FIG. 4, the storage tank $18_a$ has externally mounted thereon a thermostat 84 used to control the operation of the water heater's electric resistance heating element 86 to maintain the tank water at a predetermined heated supply temperature.

Thermostat 84 is held in place against the exterior side of the tank $18_a$ by a metal bracket 87 which is in turn secured to an outer end portion 90 of the heating element 86 by means of a Tinnerman clamp portion 92 of bracket 87. A metal tab 94 is spot welded, as at 96, to the bracket 87 and is connected by a grounding wire 98 to the thermostat and junction bracket portion 100 of an electrical junction box 102. Junction box 102 is mounted on an exterior side surface of the jacket $14_a$ and is provided with the usual electrical power supply cord 104.

In the event that water $50_a$ begins to leak from the storage tank $18_a$ into the interior water heater annulus $24_a$, it is caught in the enlarged, sealed bottom end cap 70 (FIG. 2), without leaking outwardly through the interface between the end cap and the lower jacket end or outwardly through the bottom wall of the end cap 70, and is safely drained away from the water heater $10_a$ via the pipe 82 to a floor drain or other plumbing drainage structure. Accordingly, the enlarged, sealed bottom end cap 70 uniquely functions as an integral drainage catch pan which advantageously eliminates the previous necessity of separate, horizontally enlarged catch pans such as the pan 52 shown in FIG.

Figure 3A:
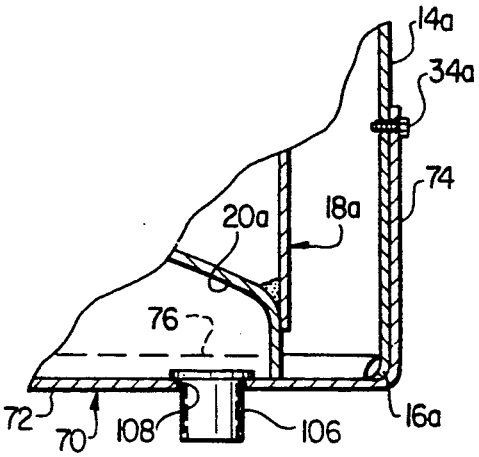
FIG. 3A is a view similar to that in FIG. 3, but illustrating an alternate placement of the drain line on the integral drainage catch basin structure.

Instead of utilizing the side wall nipple 78 illustrated in FIG. 3, the bottom end cap 70 may be alternately drained using a drain outlet fitting 106 (FIG. 3A) appropriately sealed within a circular opening 108 in the bottom cap wall 72 and operatively connectable to the drain pipe 82.

FIGS. and 2 are approximately to scale and representatively illustrate "point-of-use" electric water heaters each having a hot water storage tank capacity of about four gallons. The auxiliary catch pan 52 shown in FIG. 1 at least roughly approximates the catch pan size typically used in conjunction with the water heater 10.

Representatively, the catch pan side wall is approximately 2" high; the bottom end cap side wall 32 is approximately 1" high; the diameter of the jacket 14 is approximately 11.75"; the diameter of the auxiliary catch pan 52 is approximately 15". Accordingly, the volume of the annular catch pan receiving area is approximately 137 cubic inches.

By increasing the height of the side wall 74 of the enlarged bottom end cap 70 (FIG. 2) to approximately 1.5 inches, thereby positioning the top edge of the side wall 74 just beneath the drain valve $48_a$ as shown, the water receiving and holding capacity of the sealed end cap 70 becomes approximately 163 cubic inches—i.e., somewhat larger than that of the annular receiving volume 58 of the separate catch pan 52 shown in FIG. 1.

Accordingly, no water receiving volume capacity sacrifice need be made by incorporating the integral water heater catch pan principles of the present invention. The leakage water receiving and holding capacity of the bottom end cap 70 may be even further increased, if desired, by sizing it so that its top edge is disposed above the drain valve $48_a$ and forming an appropriate seal between the pipe $46_a$ and the end cap and jacket side wall portions through which it is extended.

The foregoing detailed description is to be clearly understood as being given by way of illustration and example only, the spirit and scope of the present invention being limited solely by the appended claims.

What is claimed is:

1. A water heater comprising:

an outer jacket having an open lower end portion;

a hot water storage tank coaxially disposed within said jacket and adapted to hold a quantity of heated water for supply to a hot water-using device, said outer jacket and said storage tank forming therebetween and being generally coaxial with an interior space disposed within said water heater and horizontally circumscribing said storage tank;

a bottom end cap having an upstanding peripheral wall telescoped upwardly over and completely encircling the horizontally facing exterior side surface portion of said open lower end portion of said outer jacket in a closely adjacent, horizontally facing relationship therewith;

sealing means for forming a water tight seal between said bottom end cap and said open lower jacket end portion received therein, said water tight seal completely circumscribing said lower jacket end portion and functioning to prevent water leaking from said storage tank into said bottom end cap from flowing upwardly out of said bottom end cap; and outlet means extending into the interior of said bottom end cap, and connectable to an external drain pipe, for draining away storage tank leakage water received therein, whereby storage tank leakage water may be captured and drained away directly from within the interior of said water heater via said outlet means to a plumbing drainage structure, thereby eliminating the necessity of placing a separate drainage catch pan structure beneath said water heater.

2. The water heater of claim 1 wherein:

said water heater is of the point-of-use type and said storage tank has a hot water holding capacity of from about two to about twenty gallons.

3. The water heater of claim 1 wherein:

said bottom end cap has an imperforate circular lower end wall, and a circular side wall extending upwardly from the periphery of said circular lower end wall, and said outlet means extend into the interior of said bottom end cap through said circular side wall thereof.

4. The water heater of claim 1 wherein:

said bottom end cap has a circular lower end wall, and a circular side wall extending upwardly from the periphery of said circular lower end wall, and said outlet means extend into the interior of said bottom end cap through said circular lower end wall.

5. The water heater of claim 1 further comprising:

means for forming an electrical grounding connection between said storage tank and said outer jacket at a point above said bottom end cap.

6. The water heater of claim 5 further comprising:

electric resistance heating means extending into the interior of said storage tank and operable to heat water therein, thermostat means for operating said electric resistance heating means in a manner maintaining water in said storage tank at a predetermined heated supply temperature, support bracket means, interconnected between said electric resistance heating means and said thermostat means, for holding said thermostat means against an exterior side surface portion of said storage tank, an electrical junction box supported on an exterior side portion of said outer jacket and having a thermostat and junction bracket portion extending inwardly through said outer jacket, and means for forming an electrical grounding connection between said support bracket means and said thermostat and junction bracket portion of said electrical junction box.

7. For use in conjunction with a water heater of the type having a cylindrical outer jacket with an open lower end portion, a smaller diameter cylindrical hot water storage tank coaxially disposed within said outer jacket, and a bottom end cap telescoped upwardly and outwardly over said open lower end portion of said outer jacket in a close fitting relationship therewith, a method of draining away water leaking from said storage tank without positioning a separate drainage catch pan structure beneath the lower end of said water heater, said method comprising the steps of:

utilizing said bottom end cap as an integral drainage catch pan structure, to receive and sealingly retain water leaking from said storage tank, by creating an annular waterproof seal between said bottom end cap and said open lower end portion of said outer jacket;

communicating an external drain pipe with the interior of said bottom end cap; and flowing storage tank leakage water from within said bottom end cap of said water heater away from said bottom end cap via said external drain pipe.

8. The method of claim 7 wherein:

said step of creating a waterproof seal between said bottom end cap and said open end portion of said outer jacket is performed by forming an annular bead of sealant material around the juncture between the bottom end of said outer jacket and said bottom end cap.

9. The method of claim 7 wherein:

said step of communicating an external drain pipe into the interior of said bottom end cap is performed by communicating the external drain pipe with an interior vertical side portion of said bottom end cap.

10. The method of claim 7 wherein:

said step of communicating an external drain pipe with the interior of said bottom end cap is performed by communicating the external drain pipe with a lower interior end portion of said bottom end cap.

11. A water heater comprising:

a vertically oriented metal outer jacket having an open lower end portion;

a metal hot water storage tank coaxially disposed within said jacket and adapted to hold a quantity of heated water for supply to a hot water-using device, said outer jacket and said storage tank forming therebetween a vertically extending space disposed within said water heater and circumscribing said storage tank;

an insulating material operatively disposed within said vertically extending space;

a metal bottom end cap telescoped upwardly over said open lower end portion of said outer jacket, said bottom end cap having an imperforate lower end wall, and a side wall portion extending upwardly from around the entire periphery of said lower end wall, said side wall portion being closely adjacent and in a horizontally facing relationship with the outer side surface of said lower end portion of said outer jacket;

means for forming an electrical grounding interconnection between said storage tank and said outer jacket at a location above said bottom end cap;

sealing means for forming a water tight seal between said bottom end cap and said open lower jacket end portion received therein, said water tight seal completely circumscribing said lower jacket end portion and functioning to prevent water leaking from said storage tank into said bottom end cap from flowing upwardly out of said bottom end cap; and outlet means extending into the interior of said bottom end cap through said circular side wall thereof, and connectable to an external drain pipe, for draining away storage tank leakage water received therein, whereby storage tank leakage water may be captured and drained away directly from within the interior of said water heater via said outlet means to a plumbing drainage structure, thereby eliminating the necessity of placing a separate drainage catch pan structure beneath said water heater.

12. A water heater comprising:

a vertically oriented metal outer jacket having an open lower end portion;

a metal hot water storage tank coaxially disposed within said jacket and adapted to hold a quantity of heated water for supply to a hot water-using device, said outer jacket and said storage tank forming therebetween a vertically extending space disposed within said water heater and horizontally circumscribing said storage tank;

an insulating material operatively disposed within said vertically extending space;

a metal bottom end cap telescoped upwardly over said open lower end portion of said outer jacket, said bottom end cap having a lower end wall, and a side wall portion extending upwardly from around the entire periphery of said lower end wall, said side wall portion being closely adjacent and in a horizontally facing relationship with the outer side surface of said lower end portion of said outer jacket;

means for forming an electrical grounding interconnection between said storage tank and said outer jacket at a location above said bottom end cap;

sealing means for forming a water tight seal between said bottom end cap and said open lower jacket end portion received therein, said water tight seal completely circumscribing said lower end portion of said outer jacket and functioning to prevent water leaking from said storage tank into said bottom end cap from flowing upwardly out of said bottom end cap; and outlet means extending into the interior of said bottom end cap through said lower end wall thereof, and connectable to an external drain pipe, for draining away storage tank leakage water received therein, whereby storage tank leakage water may be captured and drained away directly from within the interior of said water heater via said outlet means to a plumbing drainage structure, thereby eliminating the necessity of placing a separate drainage catch pan structure beneath said water heater.

* * * * *

UNITED STATES PATENT AND TRADEMARK OFFICE

CERTIFICATE OF CORRECTION

PATENT NO. : 5,134,683

DATED : July 28, 1992

INVENTOR(S) : Timothy E. Powell

It is certified that error appears in the above-identified patent and that said Letters Patent is hereby corrected as shown below:

Column 3, line 51, "8" should be --18--.

Signed and Sealed this

Seventeenth Day of August, 1993

Bruce Lehman

*Attest:*

BRUCE LEHMAN

*Attesting Officer*

*Commissioner of Patents and Trademarks*